US006752597B2

(12) United States Patent
Pacello et al.

(10) Patent No.: US 6,752,597 B2
(45) Date of Patent: Jun. 22, 2004

(54) DUPLEX SHEAR FORCE ROTOR

(75) Inventors: John Pacello, Alpine, CA (US); Frank J. Tybor, Houston, TX (US)

(73) Assignee: LBT Company, San Diego, CA (US)

( * ) Notice: Subject to any disclaimer, the term of this patent is extended or adjusted under 35 U.S.C. 154(b) by 0 days.

(21) Appl. No.: 10/254,206

(22) Filed: Sep. 25, 2002

(65) Prior Publication Data

US 2003/0059300 A1 Mar. 27, 2003

Related U.S. Application Data

(60) Provisional application No. 60/325,234, filed on Sep. 27, 2001.

(51) Int. Cl.[7] ..... F04D 29/24

(52) U.S. Cl. ..... 416/186 R; 416/198 R; 416/223 B

(58) Field of Search ..... 416/1, 185, 186 R, 416/198 R, 223 B

(56) References Cited

U.S. PATENT DOCUMENTS

| | | | | | |
|---|---|---|---|---|---|
| RE28,742 | E | * | 3/1976 | Rafferty et al. | 415/90 |
| 4,335,994 | A | | 6/1982 | Gurth | 415/90 |
| 4,514,139 | A | | 4/1985 | Gurth | 415/90 |
| 4,652,207 | A | | 3/1987 | Brown et al. | 415/90 |
| 4,752,187 | A | | 6/1988 | Hergt et al. | 416/186 |
| 4,768,920 | A | | 9/1988 | Gurth | 415/90 |
| 4,773,819 | A | | 9/1988 | Gurth | 415/90 |
| 4,940,385 | A | | 7/1990 | Gurth | 415/206 |
| 5,100,289 | A | * | 3/1992 | Caoduro | 415/56.5 |
| 5,551,553 | A | | 9/1996 | Hay | 198/624 |
| 5,797,724 | A | * | 8/1998 | Liu et al. | 415/206 |
| 6,132,080 | A | | 10/2000 | Gurth | 366/286 |

FOREIGN PATENT DOCUMENTS

| | | | | |
|---|---|---|---|---|
| DE | 37 04 360 A 1 | | 8/1988 | F04D/29/22 |
| JP | 02140494 A | * | 5/1990 | |

* cited by examiner

*Primary Examiner*—Ninh H. Nguyen
(74) *Attorney, Agent, or Firm*—Conley Rose, P.C.

(57) ABSTRACT

A single or multi-stage centrifugal pump or mixer duplex shear force rotor. The rotor is circular and consists of two non-parallel shrouds with inner, opposing faces. The driven shroud contains a center opening. The rotor has an open, unobstructed entrance section with no raised ribs and includes a protrusion designed to force-feed the discharge section in a smooth laminar flow pattern. The discharge section incorporates a series of raised ribs. The raised ribs begin at the peripheral edge of the drive and driven shrouds and extend in a direction towards the center of the drive and driven shroud and terminate approximately 50% of the distance from the periphery and the center of the rotor. Cast-in-place spacers space the drive and driven shrouds. Alternatively, the rotor can include no raised ribs. In addition, the raised ribs can have a cross-section that includes a tapered trailing edge to reduce wear. The rotor can also be used without inclusion of the raised ribs. Alternatively, neither the drive or driven shroud are perpendicular to the axis of rotation.

21 Claims, 6 Drawing Sheets

DUPLEX SHEAR FORCE ROTOR

CROSS-REFERENCE TO RELATED APPLICATIONS

The present application claims the benefit of 35 U.S.C. 111(b) provisional application Serial No. 60/325,234 filed Sep. 27, 2001, and entitled Duplex Shear Force Rotor Pump.

STATEMENT REGARDING FEDERALLY SPONSORED

Not Applicable

BACKGROUND OF THE INVENTION

1. Field of the Invention

The present invention relates generally to centrifugal pumps and mixers. More particularly, the present invention relates to centrifugal pump and mixer shear force rotors.

2. Description of the Related Art

Centrifugal pumps have been known for a number of years. A centrifugal pump is a device that converts driver energy to kinetic energy in a liquid by accelerating it to the outer rim of a revolving device known as an impeller. The impeller typically includes two "shrouds" that together form a fluid flow channel. Impellers also typically include "vanes" extending between the shrouds. Vanes are relatively thin, rigid, flat, and sometimes-curved surfaces radially mounted between the shrouds. The vanes are similar to a blade in a turbine and are used to turn the fluid. The amount of energy given to the liquid corresponds to the velocity at the edge or vane tip of the impeller. The faster the impeller revolves or the bigger the impeller, the higher the velocity of the liquid at the vane tip and the greater the energy imparted to the liquid.

As the impeller revolves, it imparts an external force on the fluid. The external force circulates the fluid around a given point to create "vortex circulation". As the external force circulates the fluid, it accelerates the fluid in the tangential direction as the fluid moves outward. Circulating the fluid thus maintains the angular velocity of the fluid. The external force accelerates the fluid by transferring momentum from the impeller to the fluid.

The vortex circulation also creates a radial pressure gradient in the fluid. The gradient is such that the pressure increases with increasing radial distance from the center of rotation. The rate of the pressure increase depends upon the fluid rotation speed and the density of the fluid being pumped.

There are a number of shortcomings associated with standard centrifugal pumps using a traditional impeller in viscous liquids. These deficiencies seriously limit the application range for centrifugal pumps. Many of the problems occur in the impeller eye where the fluid is first introduced into the impeller. The detrimental impact of these difficulties is that a conventional impeller can run in cavitation and extremely low efficiencies when pumping viscous fluids. A conventional impeller can also have high abrasive wear when pumping abrasive fluids. Although some of these downfalls can be overcome by modifications to the pump and the pumping system, such modifications are costly.

When impeller vanes of a centrifugal pump travel through a fluid, they produce a pressure distribution that has a positive pressure on the forward face of the vane and a negative pressure on the backside of the vane. The intensity of the negative pressure zone depends on the radial flow velocity of the fluid behind the vanes and the rotational velocity of the impeller. This type of pressure distribution is inherent in a pump utilizing a vaned impeller.

Cavitation can occur in the negative pressure zone in the area having the lowest static pressure. In a standard vaned impeller, the lowest pressure is at the fluid inlet, and more specifically on the rear side of the vane at the fluid inlet. If the static pressure on the fluid in the pump drops below the vapor pressure for the fluid, vapor pockets will be formed. Cavitation occurs when the vapor pockets move from the low-pressure zone to the high-pressure area and implode. Cavitation severely restricts the performance of the pump.

In order to avoid cavitation, suction pressure must be increased so that even the low-pressure areas at the impeller inlet have sufficient pressure. Increasing suction pressure causes the static pressure to be higher than the vapor pressure of the fluid. It is very expensive, however, to provide additional inlet pressure to a pump to suppress cavitation. Also, the location in which the pump is being used may not allow for the alterations required to increase the inlet pressure.

Simply stated, with traditional impeller designs, viscous liquids like heavy oil, highly concentrated slurries, and sludges are not able to accelerate quickly enough to fill the voids created behind the vanes of a rotating impeller. This causes the pump to cavitate and in some instances, stop pumping totally.

Traditional centrifugal pumps also experience shortcomings with respect to abrasion. When pumping abrasive slurries, the rate of wear is a function of the type and the concentration of the solids in the slurry and the velocity between the surface of the impeller and adjacent fluid layer. There is a layer of relatively dormant fluid, called the boundary layer, next to the surfaces of the impeller. The Reynolds number of the fluid determines the thickness of the boundary layer. The boundary layer provides a protective layer of fluid that helps prevent the abrasive slurry particles from coming in contact with the surface of the impeller. However, the shielding by the boundary layer is somewhat reduced when the thickness of the boundary layer is decreased. The effects of the abrasive slurries are greatest at the impeller "eye" where the fluid undergoes abrupt acceleration and changes of direction. Thus, when pumping abrasive fluids, the inlet region of the impeller will receive the most harm and be the first area of the impeller to fail.

Traditional centrifugal pumps also experience shortcomings due to having parallel disks disposed co-axially in the rotor chamber as the shrouds. Parallel disks limit the pump design to radial flow designs only and can cause tip cavitation, which is destructive to the disc impeller. Also, the spaces between the discs and the pump case are extremely high shear areas that cause a dragging force. With viscous liquids, the extremely high shear areas generate a breaking action, making these pumps very inefficient. The inefficiency results in higher horsepower requirements and also higher costs.

Traditional centrifugal pumps also experience shortcomings due to raised vanes on the impeller with square or rectangular cross sections that extend radially from the periphery (outer diameter) of the impeller towards the center. This causes a problem with abrasive slurries on the trailing side of the raised vane. The square section creates an eddy behind the vane that accelerates the abrasive solids in a slurry. Accelerating the solids induces wear, which ultimately cuts holes through the disc directly behind the vane.

Raised vanes that extend into the "eye", or center area, of the impeller are also problematic because the liquid transfers from laminar flow to turbulent flow as it enters into the "eye". This causes two problems. First, in abrasive slurry service, the additional turbulence of the liquid entering the eye creates wear. This wear causes premature failure of the disc impeller. Second, when pumping fragile products, such as crystals, which are damaged due to shear and/or turbulence, the losses of product are very high and costly.

Some traditional centrifugal pumps also experience shortcomings because they do not incorporate close tolerance wear rings. Under high suction conditions, this allows recirculation from the exit port of the impeller, down the outside of the impeller shrouds, and back to the inlet area. This design oversight makes it impossible to perform a valid NPSHR test that is required by many users.

SUMMARY OF THE EMBODIMENTS

The embodiments relate to a single stage centrifugal pump rotor. The rotor is a duplex, shear force rotor designed specifically for pumping heavy oil and any other viscous fluids or abrasive slurries. One of the embodiments of the rotor includes two non-parallel shrouds that form a fluid flow channel between their inner, opposing faces. A plurality of short, raised ribs are included between the two rotor shrouds. The raised ribs radially extend approximately 50% of the distance from the outer perimeter of the rotor towards the eye of the rotor. The duplex, shear force rotor design includes an unobstructed inlet, or charging, section that imparts ample pressure and velocity to force-feed the discharge section of the rotor. With the duplex, shear force rotor, the slurry liquid enters the suction eye in a smooth laminar flow, unobstructed by the inlet ribs.

Another embodiment of the rotor is designed for use in a multi-stage centrifugal pump. The design of the rotor allows the drive shaft to extend completely through the rotor for powering engagement with additional rotors.

In another embodiment of the rotor, the shrouds of the rotors are both angled from perpendicular with the axis of rotation. The angle of the shrouds can be designed for handling mixed and semi-mixed fluid flow. The rotor may also be mounted on a cantilever shaft in a mixer for mixing, agitation, blending, and keeping solids in suspension.

Another embodiment of the rotor does not include raised ribs between the rotor shrouds.

Another embodiment of the rotor includes raised ribs with tapered trailing edges.

Thus, the embodiments comprise a combination of features and advantages that enable them to overcome various problems of prior devices. The various characteristics described above, as well as other features, will be readily apparent to those skilled in the art upon reading the following detailed description, and by referring to the accompanying drawings.

BRIEF DESCRIPTION OF THE DRAWINGS

For a more detailed description of the embodiments of the present invention, reference will now be made to the accompanying drawings, wherein.

DETAILED DESCRIPTION OF THE EMBODIMENTS

Figure 1:
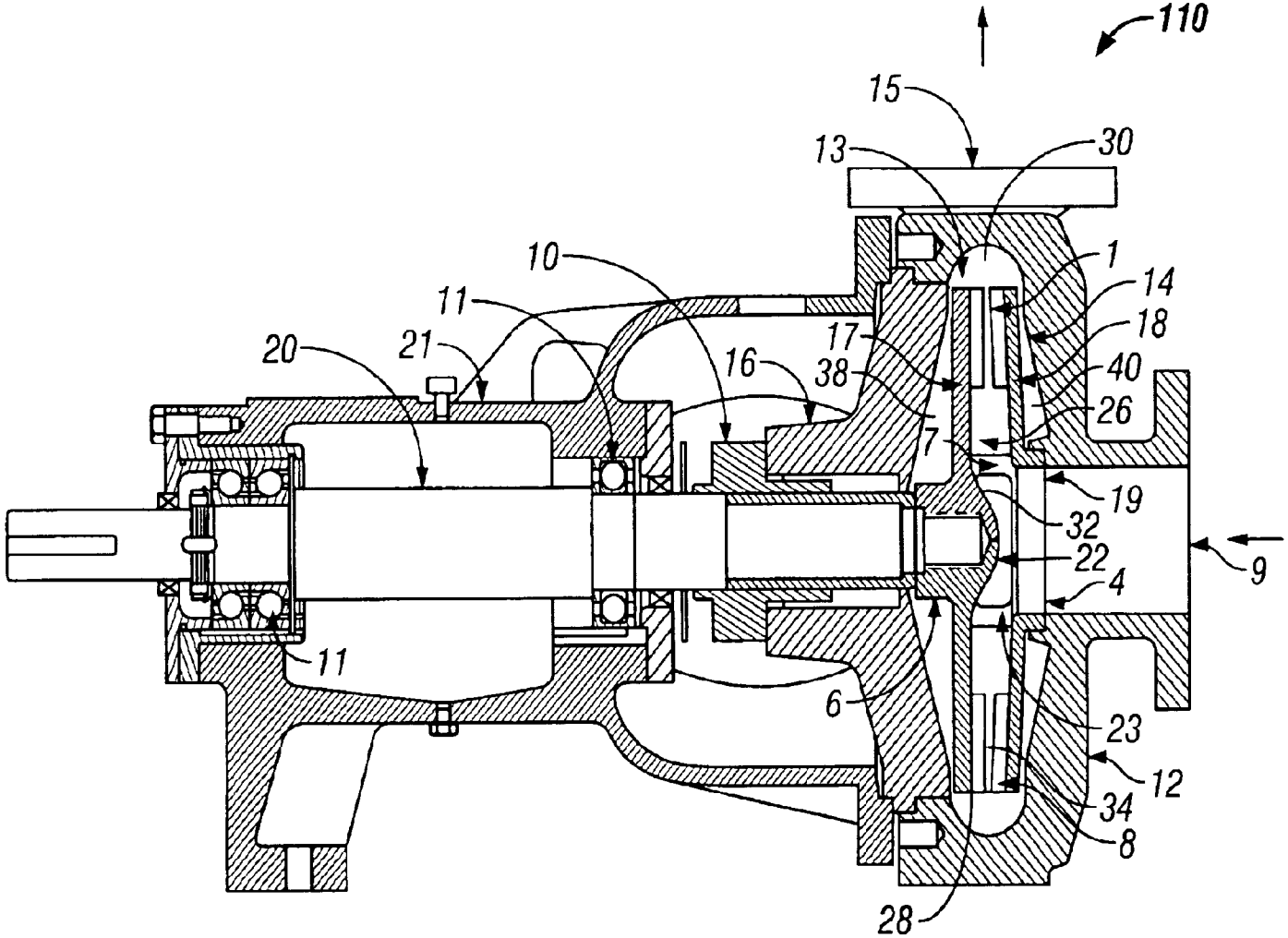
FIG. 1 is a cross section view of a horizontal single-stage pump including a duplex, shear force rotor.
Figure 2:
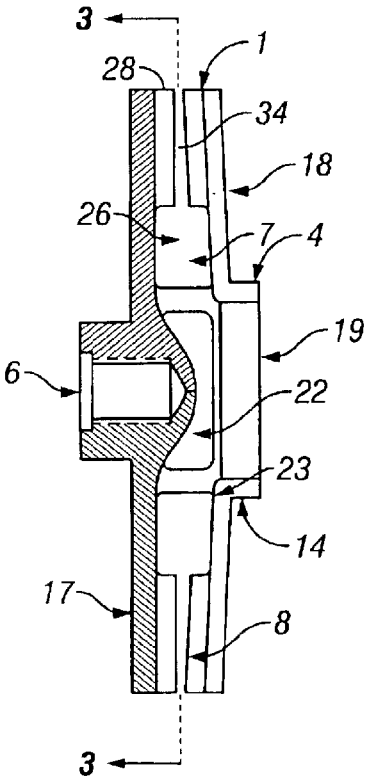
FIG. 2 is a cross sectional view of the duplex, shear force rotor taken at plane C—C in FIG. 3.

Referring now to FIGS. 1, 2, 3, and 4, there is shown a single stage pump 110 including an embodiment of a duplex, shear force rotor 14. The pump 110 pumps heavy oil and other highly viscous and abrasive slurries or sludges having solid contents, as well as fluids having entrained air or gas. The duplex rotor 14 comprises a pair of non-parallel shrouds, 17, 18 disposed co-axially. The driven rotor shroud 18 at the inlet end of the cavity 13 has a central inlet opening 19. The inlet opening 19 aligns with the case inlet 9 for allowing fluid to flow from the inlet 19 into the spacing 26 between the shrouds 17, 18. The driven shroud 18 connects to the drive shroud 17 via the cast spacers 23 spaced around and closely adjacent to the eye 19 of the driven shroud 18. The drive shroud 17 connects on its outer face 6 to a suitable drive shaft 20, which connects to a motor (not shown) for driving the rotor 14. The portion of the rotor hub 22 that protrudes into the entrance section of the rotor 19 gently turns the liquid from axial flow to radial flow or a mixed flow pattern.

Figure 3:
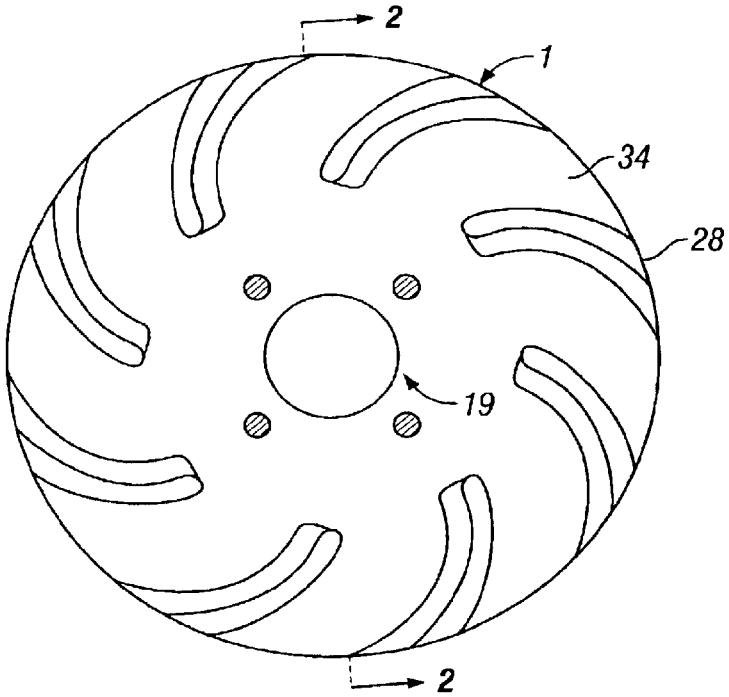
FIG. 3 is a perspective view taken from the front of the duplex, shear force rotor taken at plane A—A in FIG. 2.

A plurality of raised ribs 1 are positioned between the two adjacent circular rotor shrouds 17, and 18. As best shown in FIG. 3, the raised ribs 1 radially curve from the outer peripheral edge 28 of the rotor shrouds 17, 18 towards the center aperture 19 of the driven shroud 18. The raised ribs 1 are shown in FIG. 3 as extending approximately 50% of the distance from the outer peripheral edge 28 towards the center aperture 19 of the rotor 14. However, it should be appreciated that raised ribs of different length and shape may be utilized on the rotor 14. In practice, it has been found that the raised ribs 1 preferably can extend from about 25% to about 75% of the distance from the outer peripheral edge 28 to the center aperture 19 of the rotor shrouds 17, 18. The raised ribs 1 can also vary in shape and angular position from the raised ribs 1 shown in FIG. 3.

Preferably, the drive shroud 17, rotor hub 22, and raised ribs 1 are a cast component of a suitable alloy compatible with the pumpage, i.e., the fluid being pumped. Accordingly, the cast spacers 23 secure these components into a single unit. The cast spacers 23 maintain the spacing 26 between the rotor shrouds 17, 18 and provide the required strength and rigidity to prevent the shrouds 17, 18 from flexing during operation. The number and position of raised ribs 1 is determined by the performance characteristics desired for a particular pump.

Figure 4:
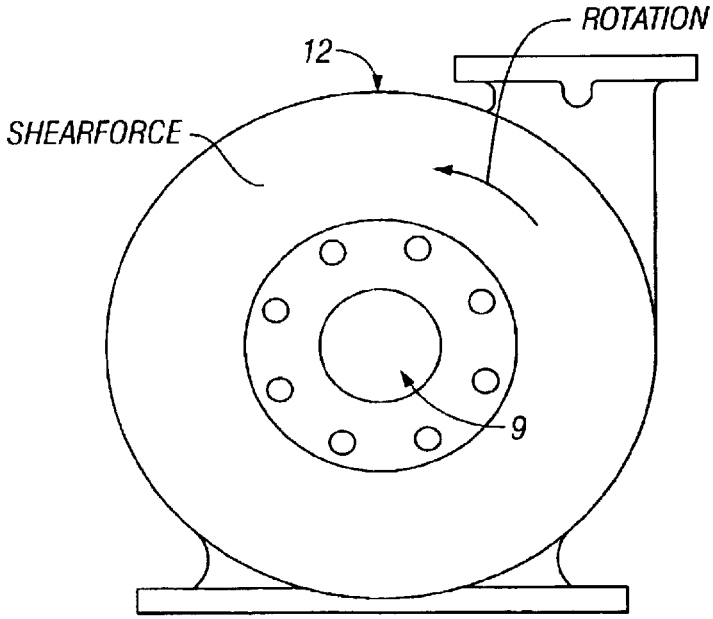
FIG. 4 is an end view of the suction side of the single stage pump case.

As shown in FIGS. 1 and 4, the pump 110 has an outer housing or casing 12, which defines a chamber 13. The housing 12 and chamber 13 are generally cylindrical in shape. The chamber 13 has an inlet opening 9, and discharge opening 15. The inlet (suction) opening 9 is positioned on the chamber 13 to provide an inlet into the center of the chamber 13. The discharge opening 15 is positioned on the outer tangential edge of the chamber 13.

The duplex rotor 14 is designed for ease of production of the rotor 14 and is preferably manufactured from a single cast component. However, it is also acceptable to fabricate the rotor 14 from a weldment or machine from a billet for prototyping and testing. The duplex rotor 14 of the pump 110 is positioned in chamber 13 in the outer housing 12. However, the rotor 14 does not completely fill the chamber 13. There is an annular space 30 defined around the outer edge 28 of the rotor 14. The discharge opening 15 is located in a portion of the annular space 30 around the outer periphery 28 of the rotor 14.

A motor (not shown) rotates the rotor shaft 20, which causes the duplex rotor 14 to rotate. The fluid to be pumped is introduced into the pump 110 through inlet opening 9. The fluid moves into the entrance section 7 between shrouds 17, 18 that communicates with the inlet opening 9. The fluid entering the entrance section 7 flows into the spacing 26 provided between the drive and driven rotor shrouds 17, 18. The curved inlet 22 on the drive rotor shroud 17 assists the fluid entering the entrance section 7 in changing direction from axial flow to radial, or mixed, flow in the space 26 between the rotor shrouds 17, 18. The change in direction is accomplished in a smooth, shock-less manner, thus maintaining the fluid in a laminar flow. By changing the direction of the fluid entering the pump 110, a portion of the inlet velocity of fluid is recovered and utilized by the rotor 14. Recovering a portion of the inlet velocity of the fluid helps to increase the efficiency of the pump 110.

The rotation of the shear force rotor 14 causes the fluid located between the rotor shrouds 17, 18 to rotate by transferring momentum to the pumpage. The viscous drag of the fluid allows momentum to be transferred from the walls of the rotating shrouds 17, 18 to the fluid. Viscous drag results from a natural tendency of a fluid to resist flow. Viscous drag occurs whenever a velocity difference exists between a fluid and the constraining passageway in which the pumpage is located.

As the rotor 14 rotates, the fluid moves in the direction of rotation of the rotor 14 and radially away from the center 32 of the rotor 14. The energy transfer begins slowly at the center of the entrance section 7 of the rotor 14 adjoining the fluid inlet 9 and increases as the fluid moves radially further away from the center 32 of the rotor 14. The fluid travels in a substantially spiral path from the center 32 of the rotor 14. This forces the fluid into the peripheral section 8 of the rotor 14 and finally to the outer periphery 28 of the rotor 14.

As the fluid moves from the entrance section 7 to the peripheral section 8 and then the outer periphery 28 of the duplex rotor 14, the raised ribs 1, which are positioned between the rotor shrouds 17, and 18, engage the fluid. The raised ribs 1 impart additional momentum to the fluid being pumped. The raised ribs 1 and the rotor shrouds 17, 18 define a plurality of channels 34 in which the fluid is confined. The fluid is accelerated in the channels 34 and the fluid moves radially outward into regions of higher rotor velocity. Thus, once the raised ribs 1 engage the fluid, they accelerate the fluid as the fluid moves further away from the center 32 of the rotor 14.

The use of the open shear force area of the entrance section 7 to transfer momentum to the fluid reduces the problems that are normally associated with pumps that use a conventional impeller containing vanes. The momentum transferred by the internal portion 22 of the entrance section 7 increases the speed of the fluid so that it is closer to the speed of the peripheral section 8 containing the raised ribs 1. Also, there is very little change of direction of the fluid advanced by the entrance section 7 of the rotor 14 when the raised ribs 1 engage the fluid. Consequently, there is a minimum of disruption at the location where the fluid is engaged by the raised ribs 1. Also, the entrance section 7 increases the static pressure on the fluid as the fluid is advanced towards the peripheral section 8 encompassing the raised ribs 1. The pressure on the fluid increases, keeping the pressure higher than the vapor pressure of the fluid. Therefore, when the pressure on the fluid increases, the static pressure on the fluid acts to suppress cavitation in the fluid. The raised ribs 1 are positioned in the rotor 14 so that the fluid engaged by the raised ribs 1 will be under sufficient static pressure to eliminate cavitation.

The entrance section 7 (smooth shroud portion) of the rotor 14 therefore provides initial momentum transfer to the fluid. The shrouds 17, 18 easily handle the fluid at the inlet opening 19, and begin pumping the fluid. The velocity and static pressure imparted to the fluid optimizes the conditions of the fluid for engagement by the raised ribs 1. Thus, the entrance section 7 (smooth passages) and the peripheral section 8 (ribbed passages) contribute to maximize the performance of the duplex shear force rotor 14.

The peripheral, raised ribbed section 8 of the rotor 14, provides high efficiency momentum transfer to the pumpage. The raised ribbed section 8 produces a substantial portion of the momentum transferred to the fluid while the entrance section 7 protects the raised ribs 1 from the effect of undesirable fluid inlet conditions. The increase in fluid pressure in the raised ribbed section 8 can be from about 5 to about 20 times the increase over entrance section 7 of the rotor 14.

As the fluid is pumped, it leaves the entrance section 7 of the rotor 14 and moves into the peripheral section 8 for an additional pressure boost and continues to the outer periphery 30 of the chamber 13. The fluid is under pressure and passes through the discharge opening 15 located in the outer periphery 30 of the chamber 13. The pressure and velocity of the discharged fluid depends on the rotation speed and diameter of the duplex rotor 14, the space 26 between the two shrouds 17 and 18, the number and configuration of raised ribs 1, and the viscosity of the fluid being pumped. By varying the above factors, the pump 110 can be modified to pump most fluids efficiently at the desired pressure and flow rate.

The pump 110 is also used to pump abrasive fluids. Abrasive fluids contain solids that can abrade surfaces that the solids contact. A boundary layer of fluid adjacent to the surface of the rotor shrouds 17, 18, however, provides protection for the components of the pump 110. The Reynolds number of the fluid initially determines the thickness of the boundary layer. However, abrupt acceleration and changes in direction of the fluid in the pump 110 can significantly reduce the depth of the boundary layer. If the thickness of the boundary layer is reduced sufficiently, the abrasive solids in the fluid can impinge directly against and abrade the rotor shrouds 17, 18.

In the pump 110, the rotor 14 does not subject the fluid being pumped to any abrupt acceleration or changes in direction. At the entrance section 7, the fluid moves into the space 26 provided between the shrouds 17 and 18. The rotation of rotor 14 gradually increases the velocity of the fluid. When the fluid engages the raised ribs 1, the fluid is traveling at substantially the same velocity and in substantially the same direction as the leading section of the raised ribs 1. Therefore, there are no abrupt changes in velocity or direction for the fluid to undergo. Thus, the rotor 14 maintains the protective boundary layer and successfully pumps abrasive fluid. In pumping abrasive fluids, the size of the particles in the fluid must be smaller than the spacing 26 between the rotor shrouds 17, 18 and must also be smaller than the channels 34 between the raised ribs 1. The particles must also be able to pass through the suction inlet 9 and discharge nozzle 15.

The duplex rotor pump 110 is particularly suitable for materials carrying entrained air or gas, which would be likely to cause "air locking" in centrifugal pumps. The pump 110 is also useful for applications where rapid changes in flow conditions are experienced.

The pump 110 overcomes the problems of many of the prior art pumps. With the inner, opposing faces of shrouds 17, 18 being non-parallel, the resulting reduced area at the exit port 15 of the rotor 14 prevents tip cavitation. The inner, opposing faces of the shrouds 17, 18 taper towards each other as they extend radially toward the periphery 28, thereby narrowing towards the periphery 28. The non-parallel shrouds 17, 18 also create more space 38, 40 between the outer faces of rotor shrouds 17, 18 and the pump case 12. This reduces the breaking action and lowers the horsepower requirement as compared with pumps with parallel shrouds. Also, with the rotor 14 not having the ribs 1 extend into the center 32 of the rotor 14, laminar flow is maintained in the center aperture 19 and damage to products being pumped and wear in the center area 32 of the rotor 14 is eliminated.

The pump 110 also incorporates an anti-bypass ring 4 that allows for a proper NPSHR test. The anti-bypass ring 4 is cast as part of the rotor 14. In operation, the anti-bypass ring 4 prevents back flow into the suction area at center aperture 19 after it has exited the rotor shrouds 17, 18. During the first overhaul of the pump 110, the anti-bypass ring 4 can be machined away and replaced with a new replaceable ring.

Figure 5:
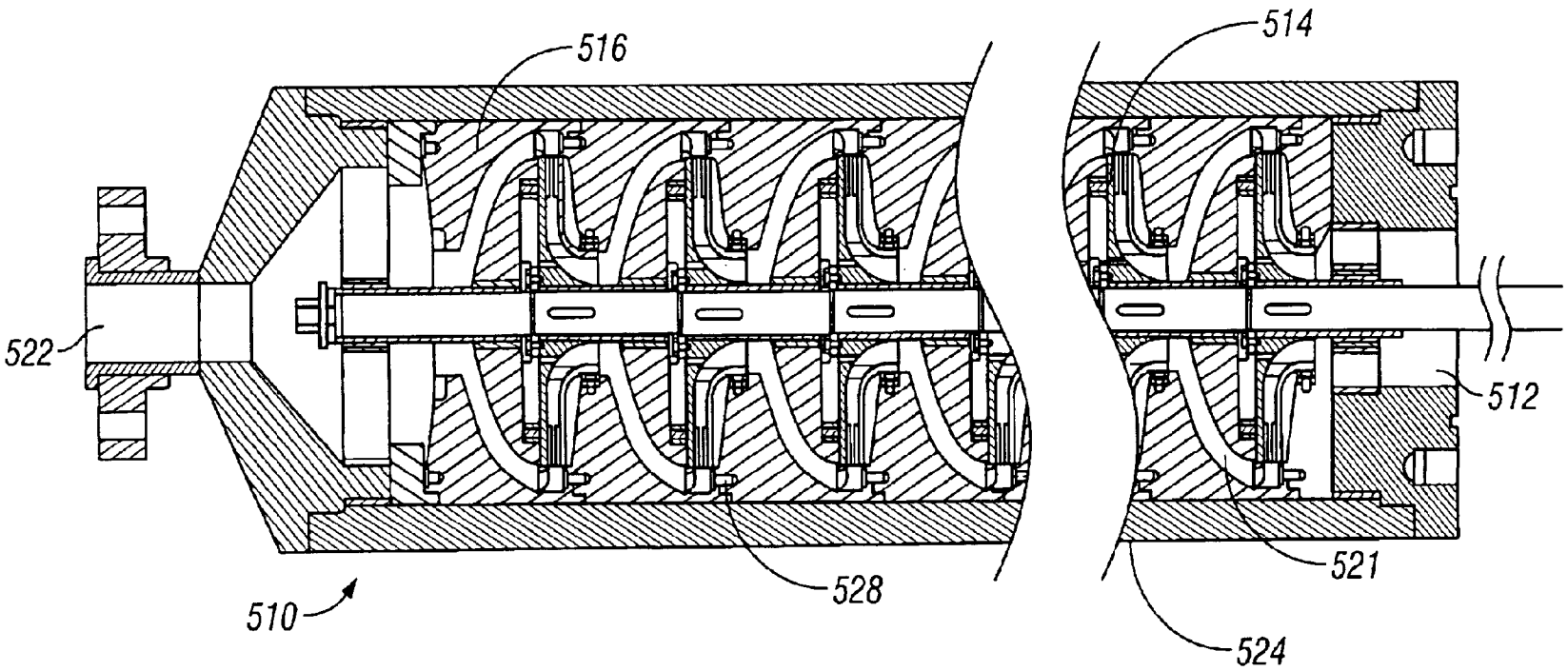
FIG. 5 is a cross sectional view of a horizontal multi-stage pump including another embodiment of a duplex, shear force rotor.
Figure 5A:
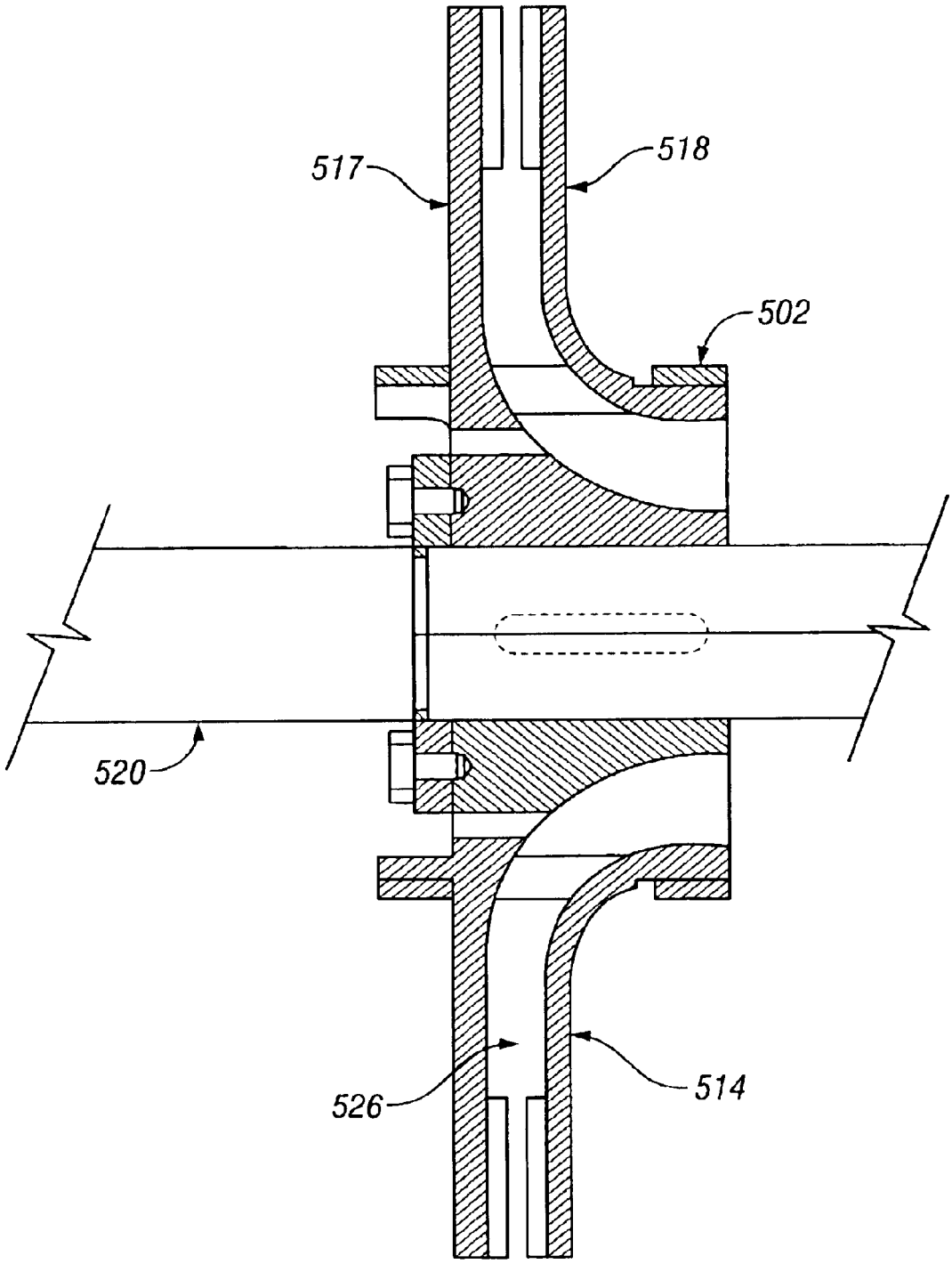
FIG. 5A is a cross sectional view of the duplex, shear force rotor constructed in accordance with the rotor of FIG. 5A.

Referring now to FIGS. 5 and 5A, there is shown another embodiment of a rotor 514 included in a multi-stage centrifugal pump 510. As shown in FIG. 5, the pump 510 comprises an inlet section 512 located on one side of the pump case 524. The pump 510 also comprises multiple duplex, shear force rotors 514 spaced horizontally inside the pump case 524. Also inside the pump case 524 are diffuser assemblies 516 that incorporate thrust balancing for the rotors 514. The diffuser assemblies 516 are connected with location pins 528. As shown in FIG. 5A, the rotor shrouds 517, 518 form a curved space 526 such that drive shaft 520 can be inserted through the center of rotor 514. This allows multiple rotors 514 to be mounted co-axially within pump 510. The rotor 514 also comprises a removable anti-bypass ring 502.

The pumped fluid enters the pump 510 at the inlet 512 and flows through a rotor cavity 521 and then through each of the rotors 514 until it reaches pump outlet 522. The fluid is then discharged from pump 510 through pump outlet 522. Increasing the number of rotors 514 increases the power of the pump 510. Thus, multi-stage pumps are typically used for high volumes of fluids.

Figure 6A:
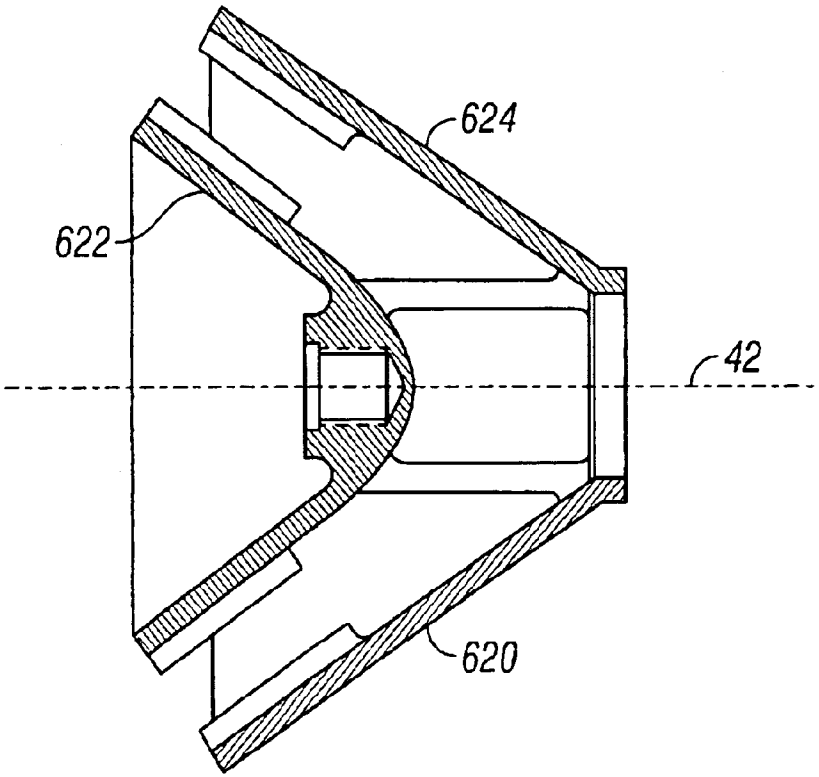
FIG. 6A is a cross sectional view of the duplex, shear force rotor constructed in accordance with the rotor of FIG. 6.
Figure 6:
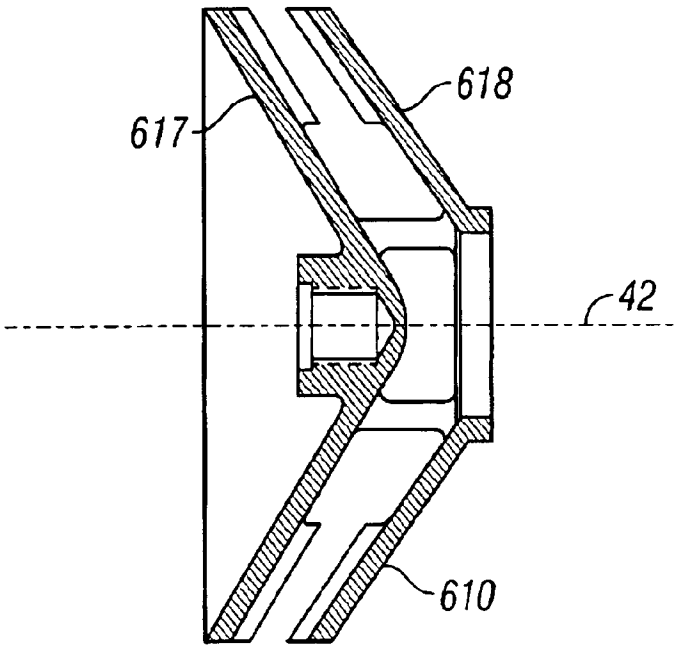
FIG. 6 is a cross sectional view of another embodiment of a duplex, shear force rotor.

Referring now to FIGS. 6 and 6A, there is shown another embodiment of shear force rotors 610, 620. Although rotors 610, 620 are shown as used in a single stage pump, it should be appreciated that rotors 610, 620 can be constructed for use in a multiple-stage pump. Unlike rotors 14 and 514, both shrouds 617, 618 of rotor 610 and 622, 624 of rotor 620 are angled from perpendicular with respect to the axis of rotation 42. The rotor 620 is designed for mixed fluid flow while the rotor 610 is designed more for semi-mixed fluid flow. Thus, the angles of the shrouds 617, 618 in FIG. 6 are such that the shrouds 617, 618 angle further away from the axis of rotation 42 than the shrouds 622, 624 of FIG. 6A.

In addition to use in centrifugal pumps, the rotors 610, 620 are suitable for mounting on a cantilever shaft of a mixer for mixing, agitation, blending, and keeping solids in suspension. With the ability to direct the flow of liquid within a containment vessel by the angle of the rotor shrouds 617, 618, 622, 624 (in relationship to the shaft), the direction of the liquids or slurries can be predetermined within the vessel to guarantee thorough mixing. A combination of rotors with a variation of flow directional angles mounted on the same shaft may also be used to scour the corners of the vessel and also move the liquid/slurry from top to bottom of the containment vessel.

Figure 7:
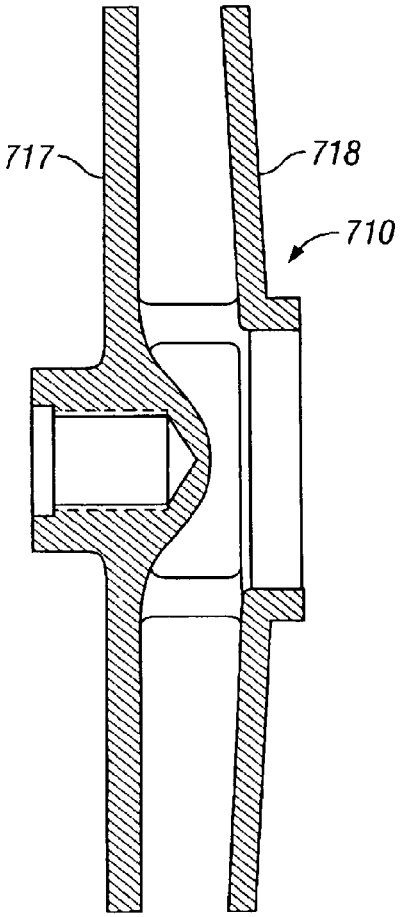
FIG. 7 is a cross sectional view of another embodiment of a duplex, shear force rotor.

Referring now to FIG. 7, there is shown another embodiment of a shear force rotor 710. Although rotor 710 is shown as used in a single stage pump, it should be appreciated that rotor 710 can be constructed for use in a multiple-stage pump. Unlike the rotors 14, 514, 610, 620, rotor 710 does not incorporate raised ribs 1 between the shrouds 717, 718. The rib-free shear force rotor 710 has similar benefits to the rotors with ribs 1, but at lower capacity and pressure. The rib-free rotor 710 can be used as an inducer for a multistage pump or in low-pressure applications where fragile or delicate pumpage is present.

Figure 8:
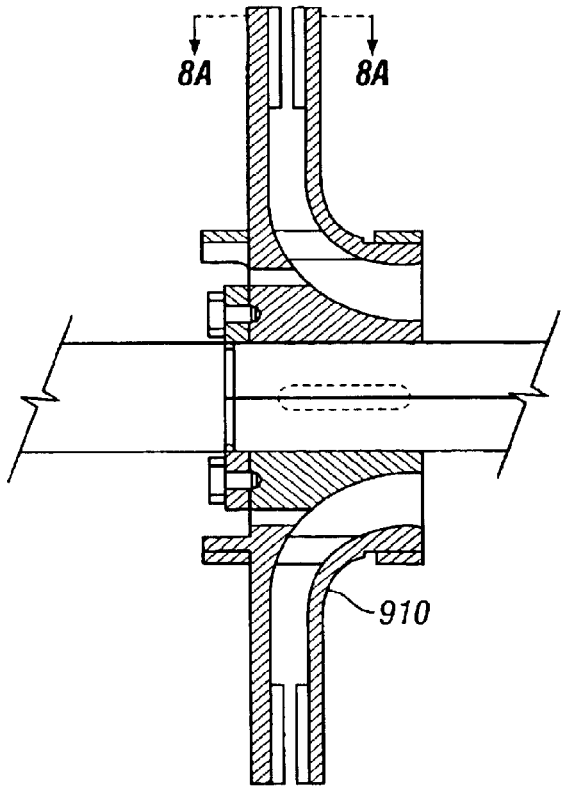
FIG. 8 is a cross sectional view of another embodiment of a duplex, shear force rotor.
Figure 8A:
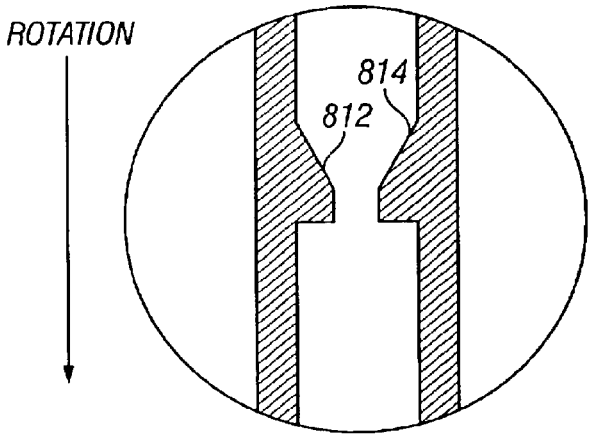
FIG. 8A is an end view of the duplex, shear force rotor constructed in accordance with the rotor of FIG. 8 taken at plane A—A in FIG. 8.

Referring now to FIGS. 8 and 8A, there is shown another embodiment of a shear force rotor 810. Although rotor 810 is shown as used in a multiple-stage pump, it should be appreciated that rotor 810 can be constructed for use in a single-stage pump. Unlike rotors 14, 514, 710, and 720, rotor 810 has raised ribs 1 with tapered trailing edges 812, 814. Problems occur with abrasive slurries on the Wailing side of raised vanes with a square or rectangular cross section. The square section causes an eddy behind the vanes that accelerates the abrasive solids in a slurry. The slurry induces wear that ultimately cuts holes through the disc directly behind the vane. The tapered trailing edges 812, 814 eliminate the eddy and thus eliminate the premature wear caused by the abrasive slurry.

While embodiments of this invention have been shown and described, modifications thereof can be made by one skilled in the art without departing from the spirit or teaching of this invention. The embodiments described are exemplary only and are not limiting. Many variations and modifications of the system and apparatus are possible and are within the scope of the invention. Accordingly, the scope of protection is not limited to the embodiments described, but is only limited by the claims that follow, the scope of which shall include all equivalents of the subject matter of the claims.

What is claimed is:

1. A rotor comprising:

a first shroud with an inner, opposing face;

a second shroud with an inner, opposing face, the second shroud having an opening therethrough;

the first and second shrouds being co-axially disposed and attached for rotation about a common axis;

wherein the second shroud is not parallel to the first shroud;

at least one raised rib mounted on at least one of the first and second shroud faces, the shrould faces having a spacing therebetween and the height of the at least one rib being less than the spacing; and wherein the at least one rib extends from a radius at least equal to the radius of the second shroud opening to the periphery of the at least one of the first and second shroud faces.

2. The rotor of claim 1 wherein the first shroud inner, opposing face includes a curved, raised protrusion adjacent to the opening.

3. The rotor of claim 2 wherein the at least one raised rib is curved and extends radially from the periphery of the at least one of the first and second shroud faces toward the center of the at least one of the first and second shroud faces.

4. The rotor of claim 3 wherein the at least one raised rib extends from the periphery of the at least one of the first and second shroud faces to between approximately 25% and 75% of the distance to the center of the at least one of the first and second shroud faces.

5. The rotor of claim 4 wherein the at least one raised rib extends from the periphery of the at least one of the first and second shroud faces to approximately 50% of the distance to the center of the first and second shroud faces.

6. The rotor of claim 2 wherein the at least one rib has a cross-section with a tapered trailing edge extending in the direction opposite of rotation.

7. The rotor of claim 2 wherein one of the first and second faces is perpendicular to the axis of rotation.

8. The rotor of claim 2 wherein neither the first or the second face is perpendicular to the axis of rotation.

9. The rotor of claim 1 wherein a rotary drive shaft engages the first shroud.

10. The rotor of claim 1 wherein the center portion of the second shroud curves away from the first shroud.

11. The rotor of claim 10 wherein a rotary drive shaft extends through the first and second shrouds.

12. The rotor of claim 1 wherein the at least one raised rib is curved and extends radially from the periphery of the at least one of the first and second shroud faces toward the center of the at least one of the first and second shroud faces.

13. The rotor of claim 12 wherein the at least one raised rib extends from the periphery of the at least one of the first and second shroud faces to between approximately 25% and 75% of the distance to the center of the at least one of the first and second shroud faces.

14. The rotor of claim 13 wherein the at least one rib extends from the periphery of the at least one of the first and second shroud face to between approximately 50% of the distance to the center of the at least one of the first and second shroud faces.

15. The rotor of claim 1 wherein the at least one rib has a cross-section with a tapered trailing edge extending in the direction opposite of rotation.

16. The rotor of claim 1 wherein the rotor is used in a centrifugal pump.

17. The rotor of claim 16 wherein the pump is used to pump fluids.

18. The rotor of claim 16 wherein the pump is used to pump abrasive fluids.

19. The rotor of claim 16 wherein the pump is used to pump fluids with solids.

20. The rotor of claim 1 wherein one of the first and second faces is perpendicular to the axis of rotation.

21. The rotor of claim 1 wherein neither the first or the second face is perpendicular to the axis of rotation.

* * * * *